US010703128B2

(12) United States Patent
Mercier

(10) Patent No.: US 10,703,128 B2
(45) Date of Patent: Jul. 7, 2020

(54) SECURITY PRINTING AND SECURITY DOCUMENTS PRODUCED THEREBY

(71) Applicant: Assa Abloy AB, Stockholm (SE)

(72) Inventor: Frantz Mercier, Hollister, CA (US)

(73) Assignee: ASSA ABLOY AB, Stockholm (SE)

( * ) Notice: Subject to any disclaimer, the term of this patent is extended or adjusted under 35 U.S.C. 154(b) by 0 days.

(21) Appl. No.: 15/889,977

(22) Filed: Feb. 6, 2018

(65) Prior Publication Data

US 2019/0241005 A1 Aug. 8, 2019

(51) Int. Cl.

| | |
|---|---|
| ***B42D 25/337*** | (2014.01) |
| ***B42D 25/00*** | (2014.01) |
| ***B42D 25/378*** | (2014.01) |
| ***B42D 25/405*** | (2014.01) |
| ***B41M 1/18*** | (2006.01) |
| ***B41M 3/14*** | (2006.01) |

(52) U.S. Cl.

CPC ..... *B42D 25/378* (2014.10); *B41M 1/18* (2013.01); *B41M 3/14* (2013.01); *B42D 25/337* (2014.10); *B42D 25/405* (2014.10)

(58) Field of Classification Search

CPC ..... B42D 25/337; B42D 2035/14; B42D 2035/16; B42D 2035/24; B42D 2035/26

See application file for complete search history.

(56) References Cited

U.S. PATENT DOCUMENTS

| | | | | |
|---|---|---|---|---|
| 2,048,780 | A * | 7/1936 | Clifford | B42D 25/29 283/94 |
| 4,884,828 | A * | 12/1989 | Burnham | B42D 25/342 283/89 |
| 4,897,300 | A * | 1/1990 | Boehm | B42D 25/355 283/85 |
| 5,243,907 | A | 9/1993 | Weishew | |
| 6,206,429 | B1 * | 3/2001 | Cull | B42D 25/29 283/114 |
| 6,405,649 | B1 | 6/2002 | Fina | |
| 7,758,078 | B2 | 7/2010 | Keller | |
| 8,321,350 | B2 | 11/2012 | Durst, Jr. | |
| 9,061,486 | B2 | 6/2015 | Bi et al. | |
| 2005/0279235 | A1 * | 12/2005 | Barthram | B41M 3/144 101/483 |
| 2016/0297232 | A1 * | 10/2016 | Lesur | B42D 25/00 |
| 2017/0259600 | A1 * | 9/2017 | Aoyama | B42D 25/29 |

FOREIGN PATENT DOCUMENTS

| | | | | |
|---|---|---|---|---|
| EP | 3023258 | A1 * | 5/2016 | B42D 25/337 |

* cited by examiner

*Primary Examiner* — Kyle R Grabowski

(74) *Attorney, Agent, or Firm* — Schwegman Lundberg & Woessner, P.A.

(57) ABSTRACT

A security document includes a first ink layer and a second ink layer. The first ink layer includes a first color in a first color zone and a second color in a second color zone offset from the first color zone in a first direction, and a first blended color including a mixture of the first and second colors in a first blended color zone between the first color zone and the second color zone. The second ink layer includes a third color in a third color zone and a fourth color in a fourth color zone offset from the third color zone in a second direction, and a second blended color including a mixture of the third and fourth colors in a second blended color zone between the third color zone and the fourth color zone. The first direction is different than the second direction.

23 Claims, 6 Drawing Sheets
(4 of 6 Drawing Sheet(s) Filed in Color)

SECURITY PRINTING AND SECURITY DOCUMENTS PRODUCED THEREBY

BACKGROUND

Security printing is the field of the printing industry that deals with the printing of security documents such as banknotes, cheques, passports, tamper-evident labels, product authentication, stock certificates, postage stamps, identity cards, among other examples. A goal of security printing is to prevent forgery, tampering, or counterfeiting. Security printing can be done on commercial printers like traditional offset and flexographic presses, as well as using newer digital platforms. One security printing technique is sometimes referred to as split ink fountain or sometimes rainbow printing, by which security documents are produced, at least in part, by printing with more than one ink in a printing fountain to achieve a unique blended color/color pattern that is difficult to reproduce.

BRIEF DESCRIPTION OF THE DRAWINGS

The patent or application file contains at least one drawing executed in color. Copies of this patent or patent application publication with color drawing(s) will be provided by the Office upon request and payment of the necessary fee. See 37 C.F.R. 1.84(a)(2)(iii).

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever. The following notice applies to the software and data as described below and in the drawings that form a part of this document: Copyright 2018, HID Global Corp. All Rights Reserved.

Figure 1A:
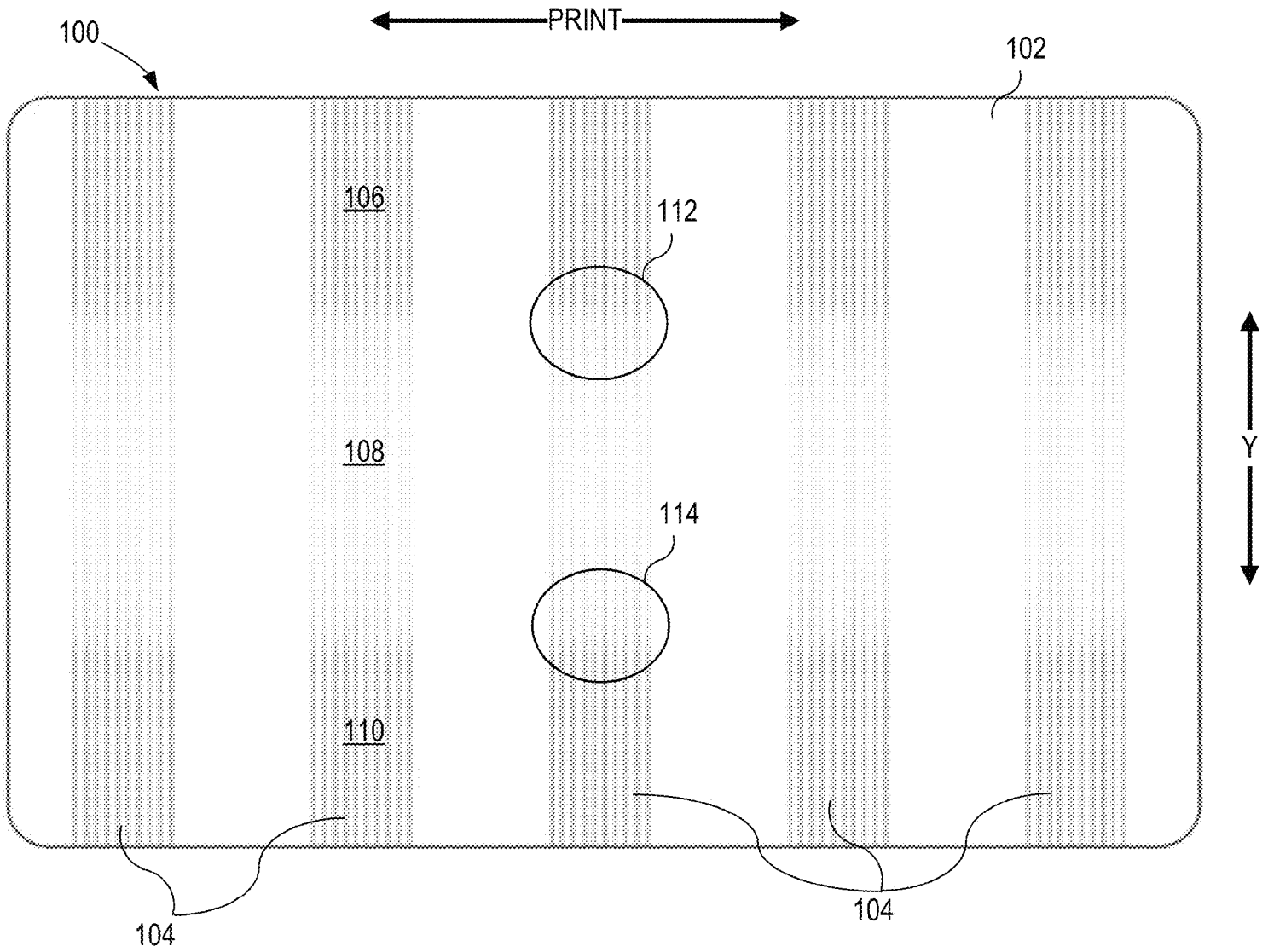

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

Figure 1B:
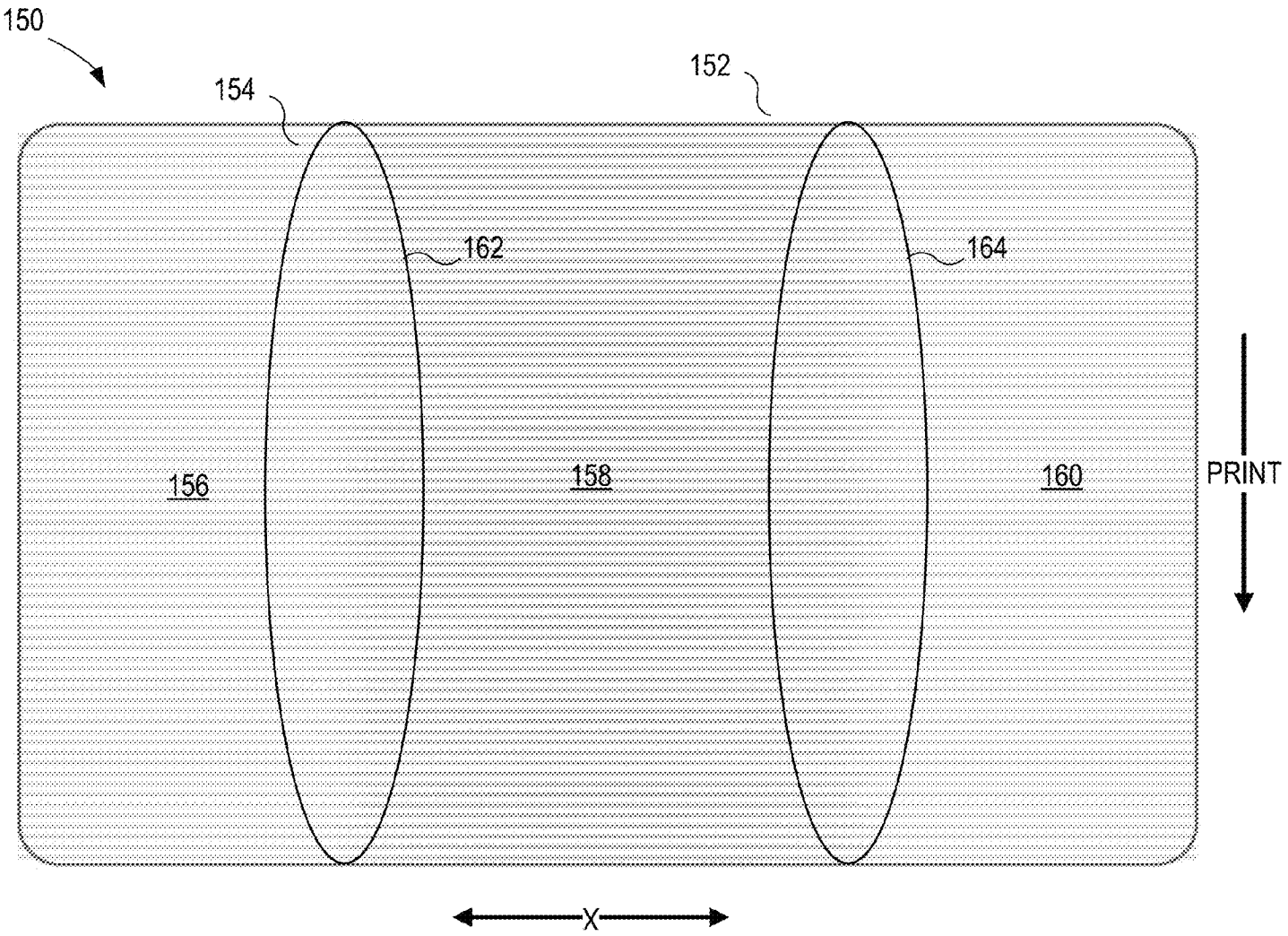

FIGS. 1A and 1B depict an example of a security document.

Figure 2:
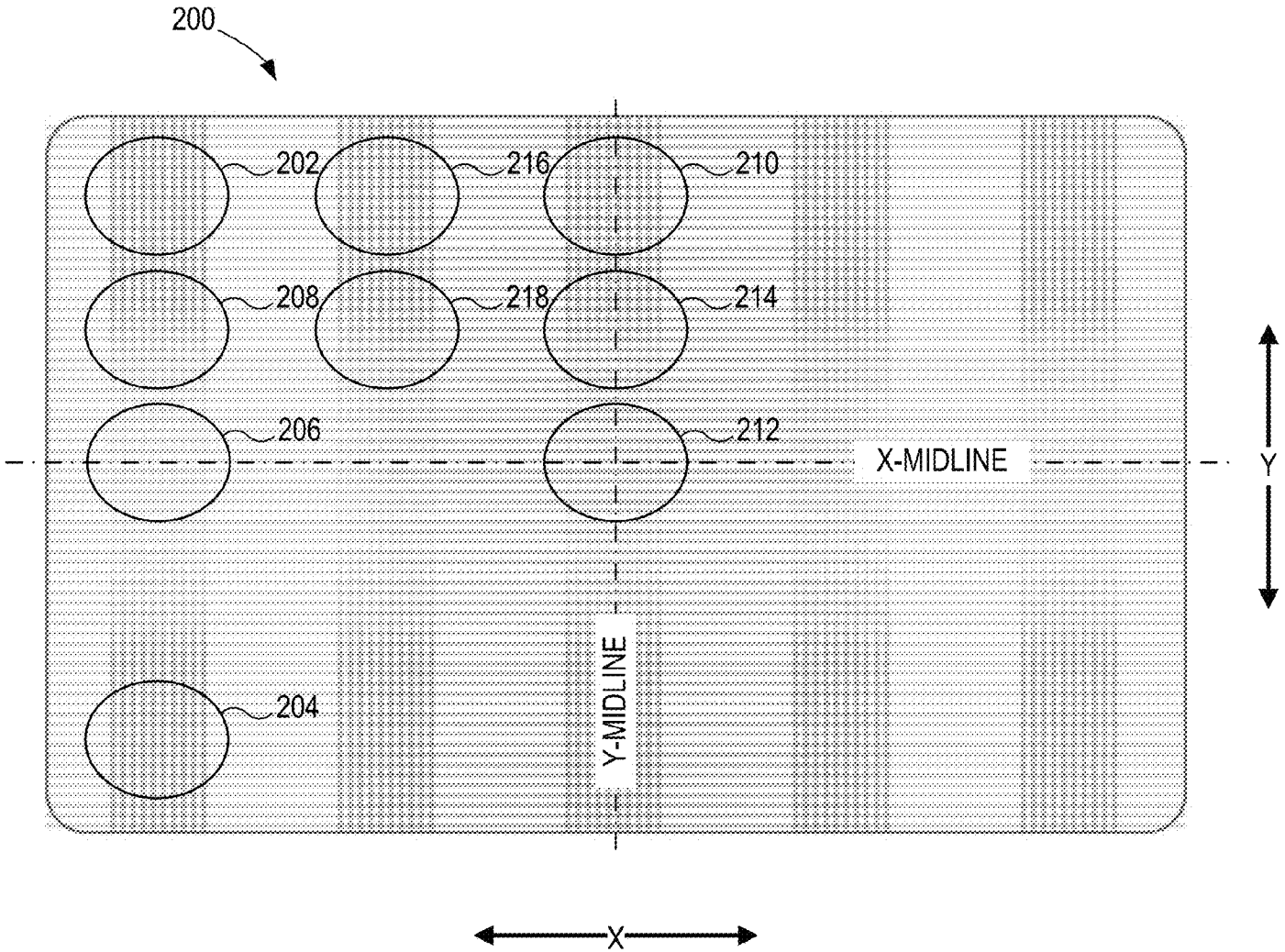

FIG. 2 depicts an example security document in accordance with examples of this disclosure.

Figure 3:
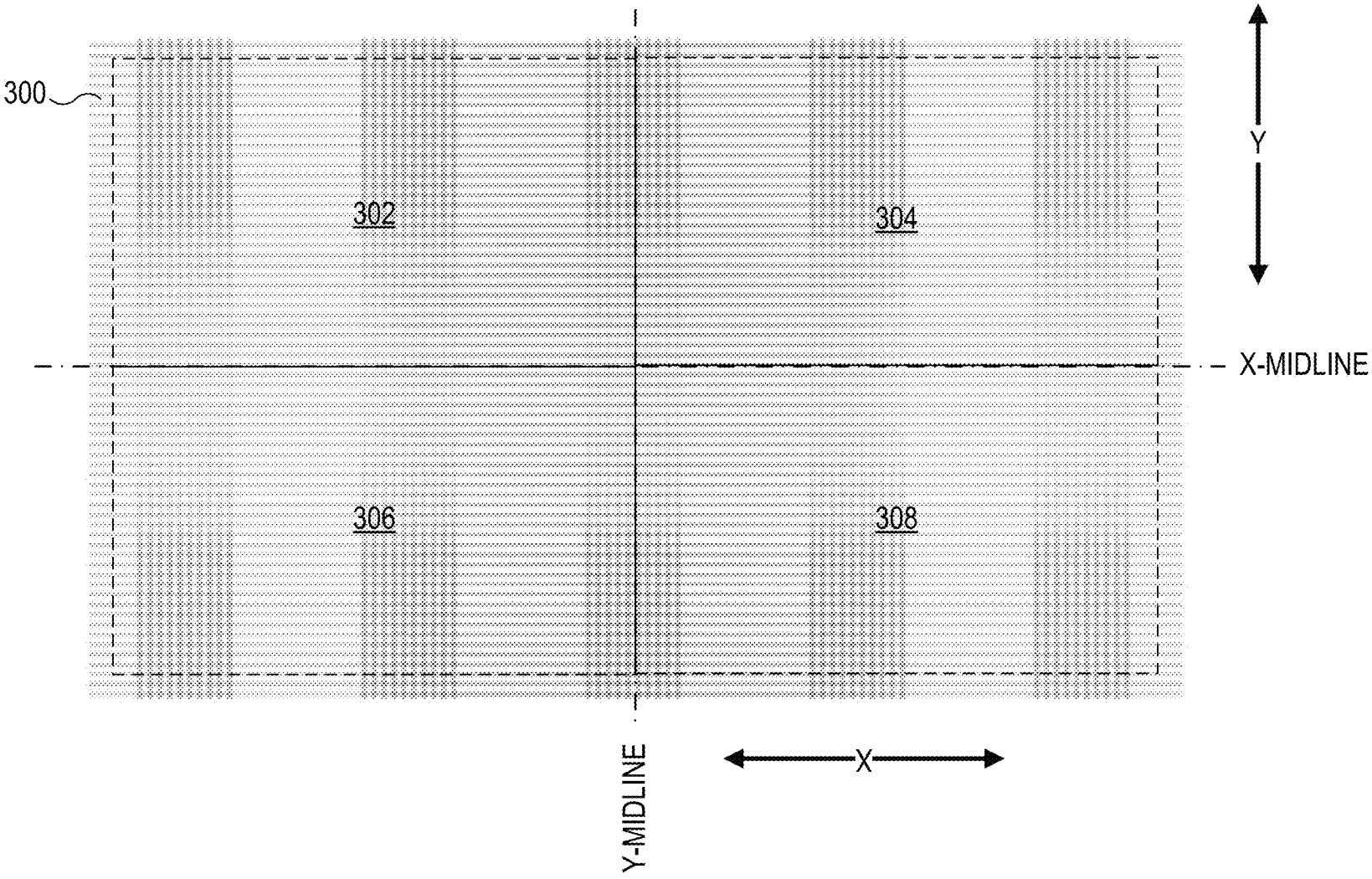

FIG. 3 depicts a portion of print media including a plurality of security documents in accordance with this disclosure.

Figure 4:
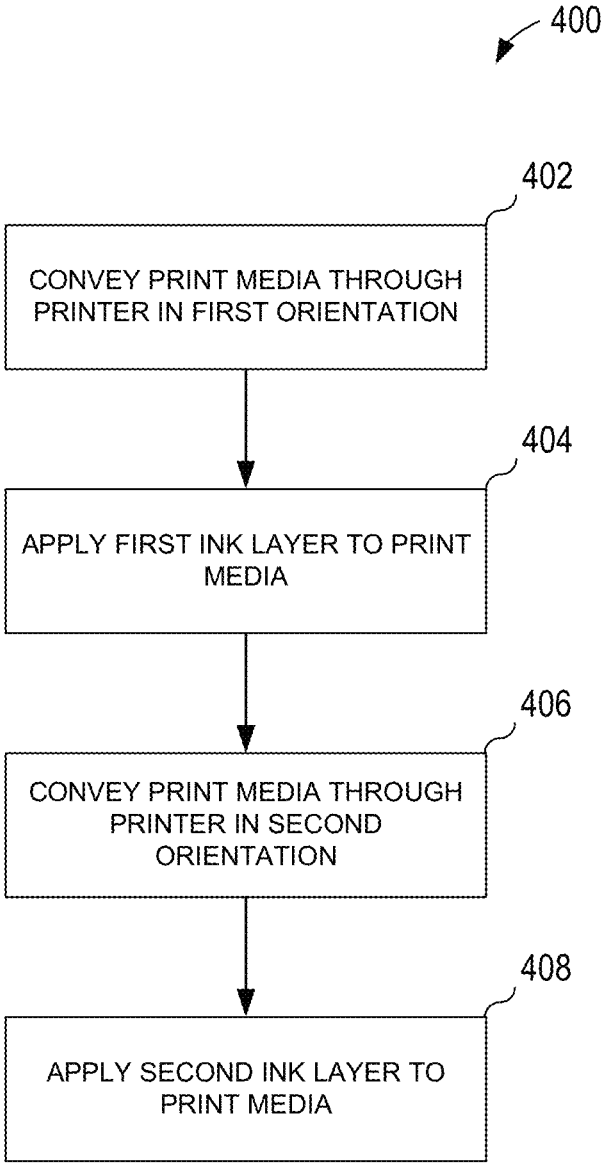

FIG. 4 is a flowchart depicting an example method of making a security document.

Figure 5:
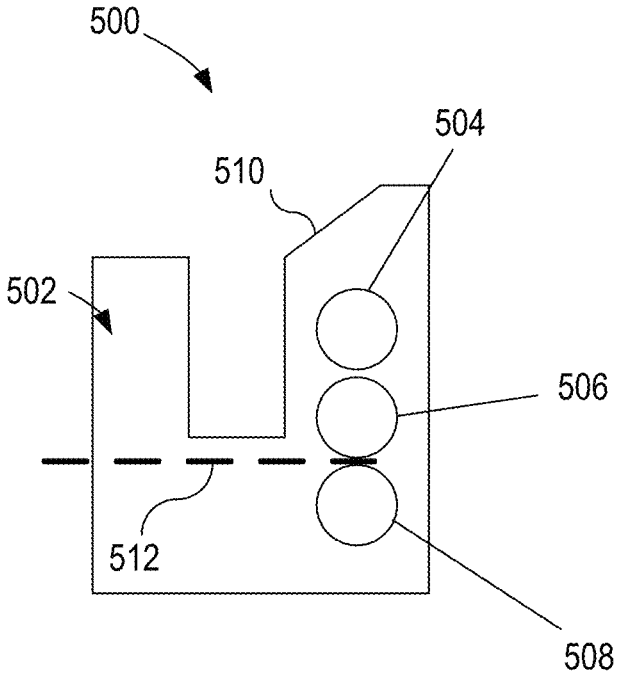

FIG. 5 is a schematic illustration of a split ink fountain printing device.

DETAILED DESCRIPTION

The present disclosure recognizes, among other things, that a security document that is difficult to copy, tamper and/or counterfeit can be produced by applying two separate color ink layers to the document in two different orientations of the document, respectively. Each of the color ink layers includes at least one blended color zone that is a mixture of multiple colors.

In an example, a security document includes a first ink layer and a second ink layer. The first ink layer includes a first plurality of color zones located adjacent one another in a first direction. Adjacent pairs of the first color zones include different colors. At least one first blended color zone is disposed between an adjacent pair of the first color zones. The at least one first blended color zone includes a first blended color that is a mixture of first and second colors of the adjacent pair of the first color zones. The second ink layer includes a second plurality of color zones located adjacent one another in a second direction. Adjacent pairs of the second color zones include different colors. At least one second blended color zone is disposed between an adjacent pair of the second color zones. The at least one second blended color zone includes a blended color that is a mixture of first and second colors of the adjacent pair of the second color zones. The first direction is different than the second direction. The first ink layer at least partially overlaps the second ink layer on the security document.

In examples, a security document is printed by a split ink fountain printing device. The security document includes a first ink layer and a second ink layer. The first ink layer includes a first color in a first color zone and a second color in a second color zone offset from the first color zone in a first direction, and a first blended color including a mixture of the first and second colors in a first blended color zone between the first color zone and the second color zone. The second ink layer includes a third color in a third color zone and a fourth color in a fourth color zone offset from the third color zone in a second direction, and a second blended color including a mixture of the third and fourth colors in a second blended color zone between the third color zone and the fourth color zone. The first direction is different than the second direction. The first ink layer at least partially overlaps the second ink layer on the security document.

As noted above, security printing can be done on many different types of devices/systems, including more traditional mechanical and/or electromechanical printing presses, as well as using newer digital platforms. One example of a more traditional, largely mechanical printing device is a split ink fountain printing press. The split ink fountain press is a variety of an offset printing press. In the split ink fountain press, however, the fountain roller (or other location at which the color ink is delivered into the press) is separated by partitions, which separate the fountain roller into multiple zones into which multiple different color inks can be delivered. As the ink progresses through the rollers of the press, the multiple colors inevitably or are controlled to blend together at the boundaries between the different zones created by the mechanical separators in the press. This blended color/color pattern created by such printing presses is difficult to reproduce and thereby security documents produced with such blended color zones may have increased resistance to copying and/or counterfeiting.

The present disclosure recognizes that a security document with more blended color/color pattern zones and more complex blends/mixtures of colors can be produced by conveying printing media, used as a base to produce a security document, through a split ink fountain printing device multiple times in multiple different orientations.

FIG. 1A is a color image depicting an example security document 100. In FIG. 1A, security document 100 is generated on print media 102, including, e.g. paper, polycarbonate, polyvinyl chloride (PVC), cardboard, plastic wrap, metal, glass or other print media suitable for receiving layers of ink in various patterns and colors. Security document 100 can be a variety of different types of security documents, including, as examples, a passport, driver's license, birth or other type of certificate, currency, bond, ID card, legal document, including, e.g., a will, credit card, pharmaceutical packaging, food packaging, regulated product packaging, event ticket, sporting cards (e.g., baseball cards), playing card (e.g., for gambling).

Security document 100 includes first ink layer 104 applied to security document 100 with a split ink fountain printing press. First ink layer 104 is depicted in the example of FIG. 1A as applied in strips or ribbons of color ink oriented in the Y direction, as indicated in the drawing. The pattern of the ink applied to a security document can vary in different examples, including complex patterns depicting people, places, shapes, text and other symbols, and other things appropriate or desired for the particular application. The colored strips or ribbons, in the example of FIG. 1A and FIGS. 1B and 1C are employed to depict the direction of color variation and to assist in understanding and to improve visual clarity with which techniques, methods, security documents, and devices in accordance with examples according to this disclosure are depicted.

First ink layer 104 includes first color zone 106, second color zone 108, and third color zone 110. First color zone 106 includes a first color ink. Second color zone 108 includes a second color ink. Third color zone 110 includes, in this example, the first color ink of first color zone 106. First ink layer 104 includes three color zones and two different colors. However, in other examples according to this disclosure, a first ink layer (or another ink layer) can include more than two color zones respectively including more than two different color inks.

Second color zone 108 is offset from first color zone 106 in a first direction, which in the example of FIG. 1A is in the Y direction. Third color zone 110 is offset from first and second color zones, 106 and 108, respectively, in the first, Y direction.

First ink layer 104 also includes first blended color zone 112 located between first color zone 106 and second color zone 108. First blended color zone 112 includes a first blended color ink, which is a mixture of the first color ink of first and third color zones 106 and 110, and the second color ink of second color zone 108. First blended color zone 112 including the first blended color ink is a unique color blend that is produced by the mechanical (or electromechanical) separators in the head or other ink entry point in a split ink fountain printing press. The blended color of first blended color zone 112 is unique in the sense that it is not precisely controlled to produce a predetermined blend of colors. Instead, as the print media is conveyed through the printing press, the separator blocks initially separate the print rollers into different regions for receiving different ink colors and, as the ink moves through rollers in the press downstream (in the direction of conveyance of print media) of the separator blocks, the different inks in the different mechanically separated zones blends together at the boundaries therebetween.

In split ink fountain printing, the direction of variation of color inks is perpendicular to the direction of printing. In the example of FIG. 1A, the direction of printing security document 100 on print media 102 is perpendicular to the Y direction, which is the direction of color ink variation.

First ink layer 104 also includes second blended color zone 114 located between second color zone 108 and third color zone 110. Second blended color zone 114 includes a second blended color ink, which is also a mixture of the first color ink of first and third color zones 106 and 110, and the second color ink of second color zone 108. The second blended color of second blended color zone 114 can be the same or similar mixture of the first and second color inks as the first blended color of first blended color zone 112, or may be a unique mixture of the first and second color inks that is different than the first blended color of first blended color zone 112. Additionally, in another example, a third color zone can include a third color that is different than the first color of a first color zone and the second color of a second color zone. In such cases, a second blended color zone could include a second blended color ink, which is a mixture of the second color of the second color zone and the third color of the third color zone. Moreover, a security document can include more than three color zones respectively including more than three different color inks and a plurality of blended color zones located between adjacent pairs of color zones.

FIG. 1B is a color image depicting another example security document 150. In FIG. 1B, security document 150 is generated on print media 152, including, e.g. paper, polycarbonate, polyvinyl chloride (PVC), cardboard, plastic wrap, metal, glass or other print media suitable for receiving layers of ink in various patterns and colors. Security document 150 includes second ink layer 154 applied to security document 150 with a split ink fountain printing press.

Second ink layer 154 includes first color zone 156, second color zone 158, and third color zone 160. First color zone 156 includes a first color ink. Second color zone 158 includes a second color ink. Third color zone 160 includes, in this example, the first color ink of first color zone 156. Second ink layer 154 includes three color zones and two different colors. However, in other examples according to this disclosure, a second ink layer (or another ink layer) can include more than two color zones respectively including more than two different color inks.

Second color zone 158 is offset from first color zone 156 in a second direction, which in the example of FIG. 1B is in the X direction. Third color zone 160 is offset from first and second color zones, 156 and 158, respectively, in the second, X direction.

Second ink layer 154 of security document 150 also includes first blended color zone 162 located between first color zone 156 and second color zone 158. First blended color zone 162 includes a first blended color ink, which is a mixture of the first color ink of first and third color zones 156 and 160, and the second color ink of second color zone 158. First blended color zone 162 of security document 150 including the first blended color ink is a unique color blend that is produced by the mechanical (or electromechanical) separators in the head or other ink entry point in a split ink fountain printing press, as described and depicted with reference to security document 100 of FIG. 1A.

In the example of FIG. 1B, the direction of printing security document 150 on print media 152 is perpendicular to the X direction, which is the direction of color ink variation on security document 150. Thus, the direction of printing and the direction of color ink variation of security document 100 of FIG. 1A is perpendicular to the direction of printing and the direction of color ink variation, respectively, of security document 150 of FIG. 1B.

Second ink layer 154 of security document 150 also includes second blended color zone 164 located between second color zone 158 and third color zone 160. Second blended color zone 164 includes a second blended color ink, which is also a mixture of the first color ink of first and third color zones 156 and 160, and the second color ink of second color zone 158. The second blended color of second blended color zone 164 can be the same or similar mixture of the first and second color inks as the first blended color of first blended color zone 162, or may be a unique mixture of the first and second color inks that is different than the first blended color of first blended color zone 162.

FIG. 2 is a color image depicting an example security document 200. Security document 200 includes first ink layer 104 of the example security document 100 of FIG. 1A and second ink layer 154 of security document 150 of FIG. 1B. In examples, first ink layer 104 is applied to security document 200 first and second ink layer 154 is applied to security document 200 second and on top of first ink layer 104. In examples, second ink layer 154 is applied to security document 200 first and first ink layer 104 is applied to security document 200 second and on top of second ink layer 154.

Security document 200 combines the features and advantages of security documents 100 and 150, each of which has normatively the same features and advantages—multiple different color zones separated by a unique blended color zone including a mixture of the colors of adjacent color zones of the multiple different color zones, to produce a security document with more complex color and/or color pattern variation, which, in turn imbue in the security document greater security against copying and/or counterfeiting. A number of examples of the features and advantages of security document 200 are described below. However, more generally, security documents in accordance with this disclosure can include a wide variety of imagery of people, places, text or other symbols, shapes, and other example imagery, which in itself may be inherently difficult to copy and/or counterfeit and which is printed in complex variations of color and color patterns to imbue in the document greater protections against untoward copying and/or counterfeiting than if printed in a single color or multiple colors without blended color zones including mixtures of different colors.

In FIG. 2, security document 200 includes color variation in both the X and Y directions. For example, security document 200 includes on the first ink layer 104 two different colors disposed in three different zones disposed adjacent one another in the Y direction. Security document also includes on the second ink layer 154 two colors disposed in three zones disposed adjacent one another in the X direction. The two colors of first ink layer 104 are different than one another and also different than the two colors of second ink layer 154. Similarly, the two colors of second ink layer 154 are different than one another and also different than the two colors of first ink layer 104.

With the combination of first ink layer 104 and second ink layer 154, security document 200 includes first color zone 202. First color zone 202 includes the first color of first color zone 106 of first layer 104 superimposed on or applied under the first color of first color zone 156 of second ink layer 154. In the example of FIG. 2, the colors and color patterns of first color zone 202 of security document 200 are mirrored across the X direction midline (labeled simply X-midline in FIG. 2) of the document in second color zone 204. In the area of the X-midline, security document 200 includes third color zone 206, which includes the second color of second color zone 108 of first layer 104 superimposed on or applied under the first color of first color zone 156 of second ink layer 154. Security document 200 includes fourth color zone 208. Fourth color zone 208 includes the first blended color of first blended color zone 112 of first ink layer 104 superimposed on or applied under the first color of first color zone 156 of second ink layer 154. The fourth color zone 208 is mirrored about the X-midline of security document between second color zone 204 and third color zone 206 in a similar manner as first color zone 202 is mirrored about the X-midline as second color zone 204.

In the region of the Y direction midline (labeled Y-midline in FIG. 2), security document 200 includes fifth color zone 210. Fifth color zone 210 includes the first color of first color zone 106 of first ink layer 104 superimposed on or applied under the second color of second color zone 158 of second ink layer 154. As depicted in FIG. 2, the colors and color patterns of fifth color zone 210 of security document 200 can be mirrored across the X-midline of the document. In the area of the intersection of the X-midline and the Y-midline, security document 200 includes sixth color zone 212, which includes the second color of second color zone 108 of first layer 104 superimposed on or applied under the second color of second color zone 158 of second ink layer 154. Security document 200 also includes seventh color zone 214. Seventh color zone 214 includes the first blended color of first blended color zone 112 of first ink layer 104 superimposed on or applied under the second color of second color zone 158 of second ink layer 154. The seventh color zone 214 can be mirrored about the X-midline of security document 200.

Security document 200 also includes eighth and ninth color zones 216 and 218, respectively. Eighth color zone 216 includes the first color of first color zone 106 of first ink layer 104 superimposed on or applied under at least a portion of the first blended color of first blended color zone 162 of second ink layer 154. Ninth color zone 218 of security document 200 includes the first blended color of first blended color zone 112 of first ink layer 104 superimposed on or applied under the first blended color of first blended color zone 162 of second ink layer 154.

The varying color zones of security document 200 along the Y direction, including the above described first, second, third and fourth color zones 202, 204, 206, 208, 216 and 218 respectively, can be mirrored across the Y-midline of security document 200 such that the left (left of Y-midline in the view shown in FIG. 2) portion of the document is the same as the right portion in terms of color and blended color variation in the Y direction. Additionally, the varying color zones of security document 200 along the X direction, including the above described first, second, third and fourth color zones 202, 206, 208, 210, 214, 216 and 218 respectively, can be mirrored across the X-midline of security document 200 such that the top (above X-midline in the view shown in FIG. 2) portion of the document is the same as the bottom portion in terms of color and blended color variation in the X direction. Additionally, color zone 206 is split by and mirrored about X-midline of document 200 and color zones 210 and 214 are split by and mirrored about the Y-midline. Sixth color zone 212 is split by and mirrored about both the X-midline and the Y-midline.

FIG. 3 is an example of multiple security documents printed on a section of print media stock. In FIG. 3, print media stock 300 has been employed to produce multiple security documents, which can be separated by, for example, cutting the stock after printing. In the example of FIG. 3, security document 302 is disposed in the upper left quadrant of stock 300 to the left of the Y direction midline (labeled Y-midline in FIG. 3) and above the X direction midline (X-midline in FIG. 3). Security document 304 is disposed in the upper right quadrant of stock 300 to the right of the Y-midline and above the X-midline. Security document 306 is disposed in the lower left quadrant of stock 300 to the left of the Y-midline and below the X-midline. Security document 308 is disposed in the lower right quadrant of stock 300 to the right of the Y-midline and below the X-midline.

Each of security documents 302, 304, 306 and 308 includes a first ink layer and a second ink layer. The first ink layer includes a first color in a first color zone and a second color in a second color zone offset from the first color zone in a first direction, and a first blended color including a mixture of the first and second colors in a first blended color zone between the first color zone and the second color zone. The second ink layer includes a third color in a third color zone and a fourth color in a fourth color zone offset from the third color zone in a second direction, and a second blended color including a mixture of the third and fourth colors in a second blended color zone between the third color zone and the fourth color zone. The first direction is perpendicular to the second direction. The first ink layer at least partially overlaps the second ink layer on the security document.

Security documents 302, 304, 306 and 308 can be produced together on a common stock of print media and then separated after printing the multiple ink layers is completed. In the example of FIG. 3, security documents 302 and 304 are mirror images of one another about the Y-midline. Additionally, security documents 306 and 308 are mirror images of one another about the Y-midline. Similarly, security documents 302 and 306 and security documents 304 and 308 are respectively mirrors of one another about the X-midline of print media stock 300.

FIG. 4 is a flowchart depicting an example method of making one or more security documents in accordance with this disclosure. In FIG. 4, method 400 includes conveying print media in a first orientation through a split ink fountain printing device (402), applying a first ink layer to the print media (404), conveying the print media in a second orientation through the printing device (406), and applying a second ink layer to the print media (408). The method of FIG. 4 may be employed to produce one or more security documents in accordance with this disclosure, including, for example, security document 200 of the example of FIG. 2 and/or security documents 302, 304, 306 and/or 308 of the example of FIG. 3.

The first ink layer of the security document printed by method 400 includes a first color in a first color zone and a second color in a second color zone, and a first blended color comprising a mixture of the first and second colors in a first blended color zone between the first color zone and the second color zone. The second ink layer includes a third color in a third color zone and a fourth color in a fourth color zone, and a second blended color comprising a mixture of the third and fourth colors in a second blended color zone between the third color zone and the fourth color zone. In some cases, the first orientation of the print media is approximately perpendicular to the second orientation of the print media.

In examples, the print media includes a discrete sheet of stock material, e.g. paper, or rolled sheet stock. In either case, as the print media is fed into and conveyed through the printing device it is generally planar and rectilinear with a major width dimension, a major length dimension, and a minor thickness dimension, e.g. based on the weight of the paper stock. The rectangular planar print media can be conveyed through the printing device with the length dimension aligned with the direction the print media is conveyed through the printer. After the first ink layer has been applied, the print media can be rotated, as an example, 90 degrees in the plane of the planar media such that the width dimension is now aligned with the direction the print media is conveyed through the printer and, in this second orientation, the second ink layer may be applied. In some examples, the major length dimension is equal to the major width dimension of the print media so that the print media is a square sheet of planar print stock material.

In examples, the print media is provided in rolled configuration, which is fed into and conveyed through the printing device to apply the first ink layer. In this case, the length of the print media is the entire length of the rolled print media. After the first ink layer is applied to the media, the media may be cut multiple times across the width such that the rolled print media is divided into multiple square sheets of print media with the first ink layer applied thereto. The multiple sheets of media are then rotated to align the width dimension with the direction of printing conveyance and the sheets are fed into the printing device serially to apply the second ink layer thereto.

In examples, multiple security documents are printed on a single piece or portion of print media stock. As such, in an example, method 400 of FIG. 4 may also include dividing the print media into multiple pieces, each of which pieces of print media includes a security document. Each of the security documents provided by dividing the print media includes the first and second ink layers. Thus, example method 400 of FIG. 4 may be employed to produce multiple security documents at one time on a common print media and then separated into individual documents after printing, consistent with and/or in a variation of the example of security documents 302, 304, 306 and 308 of FIG. 3.

FIG. 5 is a schematic illustration of a split ink fountain printing device 500. Printing device 500 includes chassis/housing 502, plate cylinder 504, blanket cylinder 506 and impression cylinder 508. Printing device 500 may be an offset printing press, which includes mechanical dividers at the head of the press 510 above plate cylinder 504, where ink is loaded into and fed through the printing device to be applied to print media 512 conveyed therethrough. Printing device 500 is merely illustrative of an example device, which can be employed to carry out methods of making and various security documents in accordance with this disclosure.

Print media 512 can include a discrete sheet of stock material, e.g. paper, or rolled sheet stock. In either case, as print media 512 is fed into and conveyed through split ink fountain printing device 500, the media is generally planar and rectilinear with a major width dimension, a major length dimension, and a minor thickness dimension, e.g. based on the weight of the paper stock. The rectangular planar print media 512 can be conveyed through printing device 500 with the length dimension aligned with the direction the print media is conveyed through the printer. After the first ink layer has been applied, print media 512 can be rotated, as an example, 90 degrees in the plane of the planar media such that the width dimension is now aligned with the direction the print media is conveyed through printer 500 and, in this second orientation, the second ink layer may be applied. In some examples, the major length dimension is equal to the major width dimension of the print media so that the print media is a square sheet of planar print stock material.

In examples, print media 512 is provided in rolled configuration (e.g., ahead of the location at which the print media enters/is fed into print device 500 in FIG. 5), which is fed into and conveyed through printing device 500 to apply the first ink layer. In this case, the length of print media 512 is the entire length of the rolled print media. After the first ink layer is applied to the media, the media may be cut multiple times across the width such that the rolled print media is divided into multiple square sheets with the first ink layer applied thereto. The multiple sheets of media can then be rotated to align the width dimension with the direction of printing conveyance and the sheets can be fed into printing device 500 serially to apply the second ink layer thereto.

In examples, multiple security documents can be printed on a single piece or portion of print media stock. For example, a unit portion of print media 512, e.g. a portion of rolled stock or one cut sheet of print stock, can be divided into multiple pieces, each of which pieces includes a security document. Each of the security documents provided by dividing the unit portion of print media 512 includes the first and second ink layers. In this manner, example printing device 500 (and other known printing devices selected depending upon and appropriate for the selected application) may be employed to produce multiple security documents at one time on a common print media and then separated into individual documents after printing, consistent with and/or in a variation of the example of security documents 302, 304, 306 and 308 of FIG. 3.

NOTES & EXAMPLES

The present application provides for the following exemplary embodiments or examples, the numbering of which is not to be construed as designating levels of importance:

Example 1 provides A security document printed by a split ink fountain printing device, the security document comprising: a first ink layer comprising a first color in a first color zone and a second color in a second color zone offset from the first color zone in a first direction, and a first blended color comprising a mixture of the first and second colors in a first blended color zone between the first color zone and the second color zone; and a second ink layer comprising a third color in a third color zone and a fourth color in a fourth color zone offset from the third color zone in a second direction, and a second blended color comprising a mixture of the third and fourth colors in a second blended color zone between the third color zone and the fourth color zone, wherein the first direction is different from the second direction and wherein the first ink layer at least partially overlaps the second ink layer on the security document.

Example 2 provides the system of Example 1 and optionally wherein the first ink layer comprises a fifth color in a fifth color zone offset from the second color zone in the first direction and a third blended color comprising a mixture of the second and fifth colors in a third blended color zone between the second color zone and the fifth color zone.

Example 3 provides the system of Example 2 and optionally wherein the first color and the fifth color are the same color.

Example 4 provides the system of Example 2 and optionally wherein the first color and the fifth color are different colors.

Example 5 provides the system of Example 2 and optionally wherein the first blended color and the third blended color are the same.

Example 6 provides the system of Example 2 and optionally wherein each of the first blended color and the third blended color are unique.

Example 7 provides the system of Example 1 and optionally wherein the first blended color is unique.

Example 8 provides the system of Example 1 and optionally wherein the second ink layer comprises a sixth color in a sixth color zone offset from the fourth color zone in the second direction and a fourth blended color comprising a mixture of the fourth and sixth colors in a fourth blended color zone between the fourth color zone and the sixth color zone.

Example 9 provides the system of Example 8 and optionally wherein the fourth color and the sixth color are the same color.

Example 10 provides the system of Example 8 and optionally wherein the fourth color and the sixth color are different colors.

Example 11 provides the system of Example 8 and optionally wherein the second blended color and the fourth blended color are the same.

Example 12 provides the system of Example 8 and optionally wherein each of the second blended color and the fourth blended color are unique.

Example 13 provides the system of Example 1 and optionally wherein the second blended color is unique.

Example 14 provides the system of Example 1 and optionally wherein the first direction is perpendicular to the second direction.

Example 15 provides a method of making a security document, the method comprising: conveying print media in a first orientation through a split ink fountain printing device; applying a first ink layer to the print media, the first ink layer comprising a first color in a first color zone and a second color in a second color zone, and a first blended color comprising a mixture of the first and second colors in a first blended color zone between the first color zone and the second color zone; conveying the print media in a second orientation through the printing device; and applying a second ink layer to the print media, the second ink layer comprising a third color in a third color zone and a fourth color in a fourth color zone, and a second blended color comprising a mixture of the third and fourth colors in a second blended color zone between the third color zone and the fourth color zone, wherein the first orientation is different than the second orientation.

Example 16 provides the method of Example 15 and optionally wherein the second color zone is offset from the first color zone in a first direction and the fourth color zone is offset from the third color zone in a second direction, and wherein the first direction is approximately perpendicular to the second direction.

Example 17 provides the method of Example 15 and optionally further comprising dividing the print media into a plurality of pieces, each of which pieces includes a security document comprising the first and second ink layers.

Example 18 provides the method of Example 15 and optionally wherein the first ink layer comprises a fifth color in a fifth color zone offset from the second color zone in the first direction and a third blended color comprising a mixture of the second and fifth colors in a third blended color zone between the second color zone and the fifth color zone.

Example 19 provides the method of Example 18 and optionally wherein the first color and the fifth color are the same color.

Example 20 provides the method of Example 15 and optionally wherein the second ink layer comprises a sixth color in a sixth color zone offset from the fourth color zone in the second direction and a fourth blended color comprising a mixture of the fourth and sixth colors in a fourth blended color zone between the fourth color zone and the sixth color zone.

Example 21 provides the method of Example 20 and optionally wherein the fourth color and the sixth color are the same color.

Example 22 provides the method of Example 15 and optionally wherein the first orientation is perpendicular to the second orientation.

Example 23 provides a security document comprising: a first ink layer comprising a first plurality of color zones located adjacent one another in a first direction, adjacent pairs of the first color zones including different colors, and at least one first blended color zone disposed between an adjacent pair of the first color zones, the at least one first blended color zone comprising a first blended color that is a mixture of first and second colors of the adjacent pair of the first color zones; and a second ink layer comprising a second plurality of color zones located adjacent one another in a second direction, adjacent pairs of the second color zones including different colors, and at least one second blended color zone disposed between an adjacent pair of the second color zones, the at least one second blended color zone comprising a blended color that is a mixture of first and second colors of the adjacent pair of the second color zones, wherein the first ink layer at least partially overlaps the second ink layer on the security document.

Various examples are illustrated in the figures and foregoing description. One or more features from one or more of these examples may be combined to form other examples.

The above detailed description is intended to be illustrative, and not restrictive. The scope of the disclosure should, therefore, be determined with references to the appended claims, along with the full scope of equivalents to which such claims are entitled.

What is claimed is:

1. A security document printed by a split ink fountain printing device, the security document comprising:

a first ink layer comprising a first color in a first color zone and a second color in a second color zone offset from the first color zone in a first direction, and a first blended color zone comprising a mixture of the first and second colors, the first blended color zone being between the first color zone and the second color zone; and a second ink layer comprising a third color in a third color zone and a fourth color in a fourth color zone offset from the third color zone in a second direction, and a second blended color zone comprising a mixture of the third and fourth colors, the second blended color zone being between the third color zone and the fourth color zone;

wherein the first direction is different from the second direction; and wherein the first ink layer overlaps the second ink layer on the security document, such that the first blended zone at least partially overlaps the second blended zone producing a blended area of overlap comprising a combination of the first, second, third, and fourth colors.

2. The security document of claim 1, wherein the first ink layer comprises a fifth color in a fifth color zone offset from the second color zone in the first direction and a third blended color zone comprising a mixture of the second and fifth colors, the third blended color zone being between the second color zone and the fifth color zone.

3. The security document of claim 2, wherein the first color and the fifth color are the same color.

4. The security document of claim 2, wherein the first color and the fifth color are different colors.

5. The security document of claim 2, wherein the first blended color zone substantially mirrors the third blended color zone about an axis of the security document.

6. The security document of claim 2, wherein the first blended color zone comprises a color that is unique from the first, second, third, fourth, and fifth colors of the security document.

7. The security document of claim 2, wherein the third blended color zone comprises a color that is unique from the first, second, third, fourth, and fifth colors of the security document.

8. The security document of claim 2, wherein the first blended color zone comprises a color that is the same as a color in the third blended color zone and that same color is unique from the first, second, third, fourth, and fifth colors of the security document.

9. The security document of claim 1, wherein the first blended color zone comprises a color that is unique from the first, second, third, and fourth colors of the security document.

10. The security document of claim 1, wherein the second ink layer comprises a sixth color in a sixth color zone offset from the fourth color zone in the second direction and a fourth blended color zone comprising a mixture of the fourth and sixth colors, the fourth blended color zone being between the fourth color zone and the sixth color zone.

11. The security document of claim 10, wherein the fourth color and the sixth color are the same color.

12. The security document of claim 10, wherein the fourth color and the sixth color are different colors.

13. The security document of claim 10, wherein the second blended color zone substantially mirrors the fourth blended color zone about an axis of the security document.

14. The security document of claim 10, wherein each of the second blended color zone and the fourth blended color zone comprise a color that is unique from the first, second, third, fourth, and sixth colors of the security document.

15. The security document of claim 1, wherein the second blended color zone comprises a color that is unique from the first, second, third, and fourth colors of the security document.

16. The security document of claim 1, wherein the first direction is perpendicular to the second direction.

17. A security document comprising:

a first ink layer comprising a first plurality of color zones located adjacent one another in a first direction, adjacent pairs of the first color zones including different colors, and at least one first blended color zone disposed between an adjacent pair of the first color zones, the at least one first blended color zone comprising a first blended color that is a mixture of first and second colors of the adjacent pair of the first color zones; and a second ink layer comprising a second plurality of color zones located adjacent one another in a second direction, adjacent pairs of the second color zones including different colors, and at least one second blended color zone disposed between an adjacent pair of the second color zones, the at least one second blended color zone comprising a second blended color that is a mixture of third and fourth colors of the adjacent pair of the second color zones, wherein the first ink layer overlaps the second ink layer on the security document, such that the first blended color at least partially overlaps the second blended color producing a blended area of overlap comprising a combination of the first, second, third, and fourth colors.

18. The security document of claim 17, wherein:

the adjacent pairs of the first color zones are offset from each other in a first direction; and the adjacent pairs of the second color zones are offset from each other in a second direction.

19. The security document of claim 18, wherein the first direction is different from the second direction.

20. The security document of claim 19, wherein the first direction is perpendicular to the second direction.

21. The security document of claim 19, wherein the first direction is in a direction of a first axis of the security document and the second direction is in a direction of a second axis of the security document.

22. The security document of claim 17, further comprising a third blended color zone disposed between another adjacent pair of the first color zones, the third blended color zone comprising a third blended color that is a mixture of fifth and sixth colors of the another adjacent pair of the first color zones.

23. The security document of claim 22, further comprising a fourth blended color zone disposed between another adjacent pair of the second color zones, the fourth blended color zone comprising a fourth blended color that is a mixture of seventh and eighth colors of the another adjacent pair of the second color zones.

* * * * *